United States Patent [19]

Young et al.

[11] 4,185,608

[45] Jan. 29, 1980

[54] SPRING TYPE BALL PROJECTING DEVICE

[75] Inventors: Ray A. Young; Craig A. Young, both of Geneva, N.Y.

[73] Assignee: Omnitec Products Corporation, Chagrin Falls, Ohio

[21] Appl. No.: 608,187

[22] Filed: Aug. 27, 1975

[51] Int. Cl.[2] ..... F41B 7/00

[52] U.S. Cl. ..... 124/16; 124/32; 124/36; 124/49

[58] Field of Search ..... 124/16, 41 R, 32, 49, 124/50, 7, 36; 46/11; 272/67

[56] References Cited

U.S. PATENT DOCUMENTS

| | | | |
|---|---|---|---|
| 327,918 | 10/1885 | Brotherhood | 272/67 |
| 3,511,225 | 5/1970 | Yokoi | 124/7 |
| 3,610,223 | 10/1971 | Green | 124/50 X |
| 3,640,262 | 2/1972 | Hunsicker | 124/7 |

FOREIGN PATENT DOCUMENTS

| | | | |
|---|---|---|---|
| 14550 | 10/1934 | Australia | 124/16 |
| 165921 | 11/1955 | Australia | 124/16 |
| 315851 | 8/1930 | United Kingdom | 124/16 |

*Primary Examiner*—Vance Y. Hum
*Assistant Examiner*—William R. Browne
*Attorney, Agent, or Firm*—Oldham, Oldham, Hudak & Weber Co.

[57] ABSTRACT

Ball propelling apparatus comprising a housing forming an in-line ball storage and supply path terminating at a ball stop positioning station, a ball launching hammer operable by a spring actuated propelling force as the spring is gradually cocked and moved over a dead center position to advance the ball hammer rapidly to knock the ball out of the apparatus under a controllable pressure.

2 Claims, 7 Drawing Figures

SPRING TYPE BALL PROJECTING DEVICE

Heretofore, a number of different types of ball throwing or propelling machines have been provided. Some of these machines in appreciable commercial use today involve various types of ball throwing arms that have suitable drive means connected thereto for storing up energy and then releasing the energy suddenly to drive the arm for ball propelling action. Many of these devices are relatively heavy and bulky and most of them are relatively expensive. Some effort has been made to provide smaller, less expensive ball throwers. Typical patents existing on structures of this type include U.S. Pat. Nos. 3,754,544; 3,511,225; 3,601,111 and 3,722,494.

There is a need for a relatively inexpensive ball propelling device which is light in weight and is adapted to throw balls a short distance, for example, for use in practicing tennis strokes in a confined area.

The general object of the present invention is to provide an improved, relatively compact, inexpensive ball propelling device, having only a minimal power requirement and controllable ball propelling force.

Another object of the invention is to provide a ball propelling device using a plastic ball storage and supply housing and having a plurality of identical parts therein for reduced molding costs.

Another object of the invention is to provide a relatively simple, uncomplicated uni-directional clutch means for use in operably securing a ball propelling hammer to a driving shaft for slowly building up forces in a spring type prime mover for a ball propelling arm or hammer in the apparatus.

Other objects of the invention are to provide an attractive appearing ball throwing device, to provide a ball throwing device that can be used in one's garage or basement or other small enclosed area; to provide a lightweight portable type of a ball propelling apparatus that can store a relatively large number of balls or the like therein; and to provide an apparatus particularly suitable for storing and automatically positioning and propelling lightweight articles such as tennis balls.

The foregoing and other objects and advantages of the invention will be made more apparent as the specification proceeds.

When referring to corresponding members shown in the drawings and referred to in the specification, corresponding numerals are used to facilitate comparison therebetween.

In the accompanying drawings.

SUBJECT MATTER OF THE INVENTION

Figure 1:
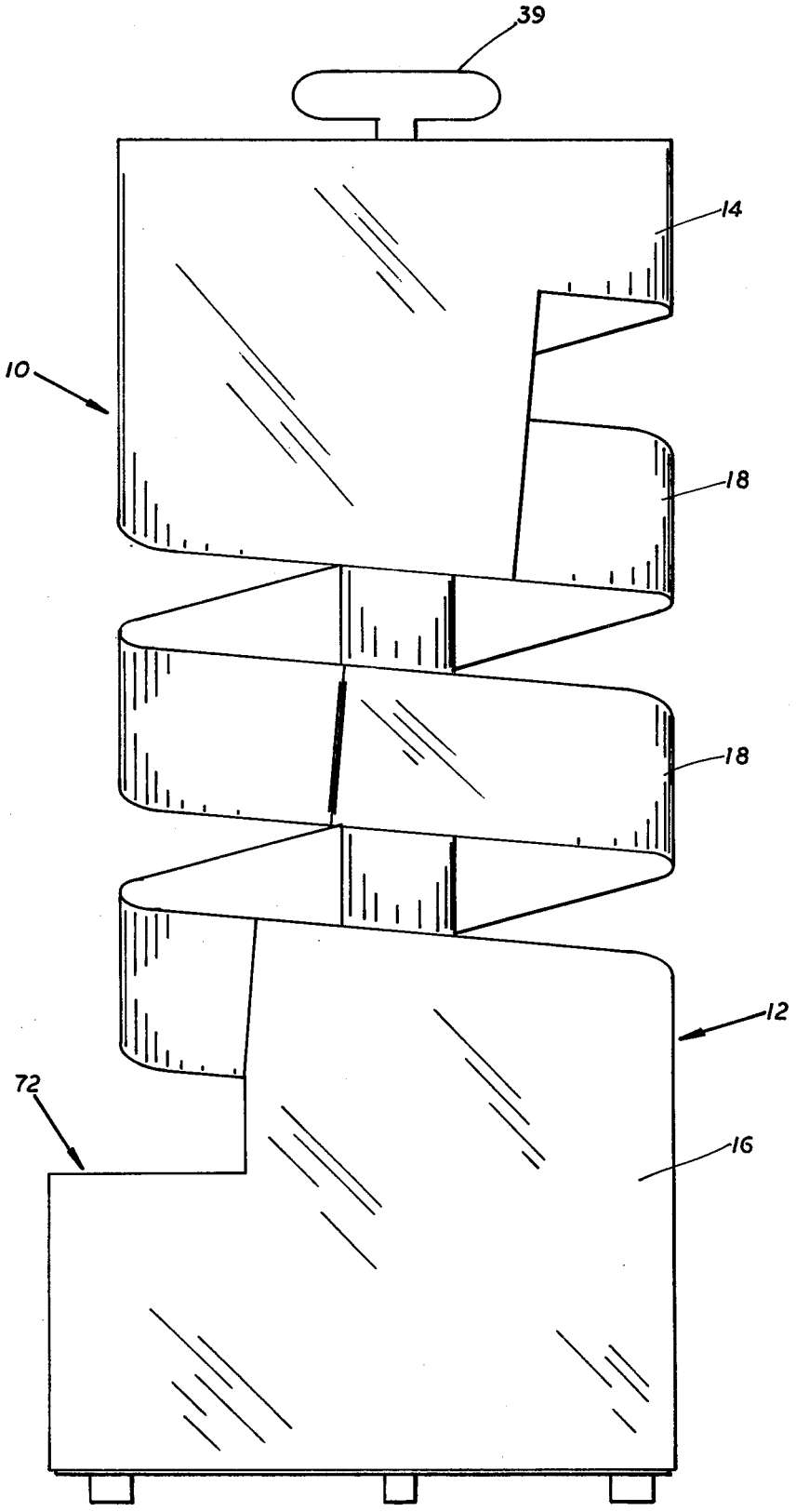
FIG. 1 is an elevation of the ball propelling apparatus of the invention.

The ball propelling apparatus, as one embodiment thereof, includes a housing formed from a plurality of molded plastic parts and defining a helical ball storage and supply path ending in a ball stop positioning station at the lower end thereof, a ball hammer means, means operable for driving the ball hammer means continuously in one direction, which hammer means is rotatably positioned to move to and through a portion of the volume of a ball positioned at said stop station, and spring means operably engaging the hammer means and extending to and anchored at one end on the housing to advance the hammer means rapidly when the spring means is moved over a dead center position by rotation of the driven hammer means to provide a rapid hammer movement for ball striking action.

Referring now to the details of the apparatus shown in the drawings, the ball propelling apparatus of the invention is indicated as a whole by the numeral 10. Usually this apparatus includes a housing 12 which is formed from a plurality of molded plastic parts to define a helical ball storage and supply path and to position components of the apparatus therein. Thus, the housing 12 is shown as made from a top section 14, a bottom section 16, and one or more intermediate sections 18. In this instance, two intermediate sections 18 are shown and they are of identical shape so as to reduce the mold costs for forming the housing components.

Figure 2:
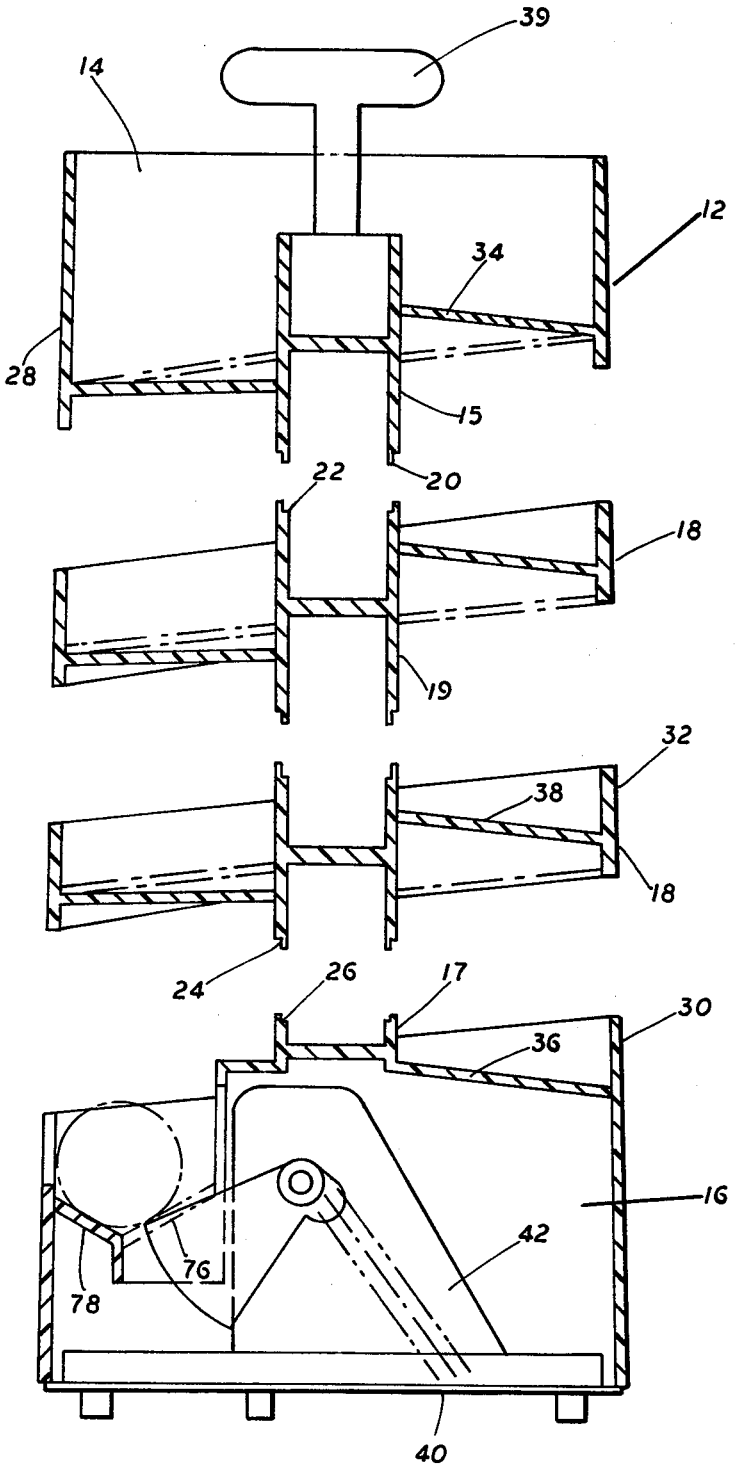
FIG. 2 is an exploded vertical section through the apparatus of the invention.
Figure 3:
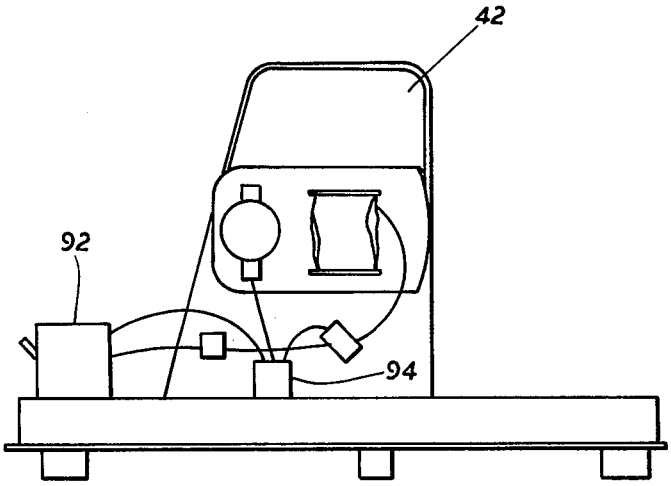
FIG. 3 is a right side elevation of the base of the apparatus and the devices mounted thereon.

FIG. 2 of the drawings best shows that each of the housing sections 14, 16 and 18 includes a center tubular portion 15, 17 and 19, respectively. It is one feature of the invention that these tubular center sections have interengaging end portions formed thereon to facilitate ready engagement of the sections to form the desired type ball storage and supply housing. Thus, an external shoulder 20 is shown on the top section, while an internal shoulder 22 is shown on the intermediate or center sections 18 and with such shoulder portions being adapted to engage telescopically to secure the sections in position. Likewise, an external shoulder 24 is formed on the lower end of each of the center sections 18, while an internal shoulder 26 is provided on the upper end of the tubular section 17. Any suitable type of adhesive can be applied to such tubular center sections 15, 17 and 19 before they are mechanically engaged with each other to form a permanent sturdy structure therefrom.

Each of these housing sections includes a cylindrical outer wall 28, 30 or 32, respectively, and downwardly inclined helix shaped support floors 34, 36 and 38 connecting between the tubular center sections and the cylindrical outer walls of the housing sections for ball support and storage action.

FIG. 1 of the drawings best shows that the various sections of the housing combine to provide a helical shaped ball storage and supply path wherein the balls will be moved by gravity down through such housing member. The top section 14 of the housing is open to permit balls to be placed on the floor 34 to roll down in the apparatus for ultimate ball striking and propelling action, as automatically provided by the apparatus when it is energized.

A suitable handle 39 is cemented or otherwise secured to the upper end of the tubular center 15 of the top section 14 to facilitate carrying the apparatus.

The bottom section 16 of the housing has a base 40 received therein and suitably secured thereto. Such base has a vertically upwardly extending support flange 42 formed integrally with a disc-like center portion 43 of the base. The support flange positions thereon in any suitable manner a drive means such as a motor 44, or a motor and speed reducer means driving an output shaft 48 which may be journalled in the flange 42, and extends therefrom in both directions. The motor usually has an adjustable slow speed output such as about 12 rpm.

In order to provide a ball propelling force in the apparatus, a striking member such as a ball hammer means 50, in the form of a metal plate, is journalled on this drive or output shaft 48. This ball hammer means 50 is more or less in the shape of an "L" and it has an operative clockwise path indicated by dotted lines at 52 in the drawings. The ball hammer means 50 has a bracket stop or extension 54 formed thereon, or suitably secured thereto, and a flat radially extending face 56 is provided on such extension or stop 54. The drive shaft 48, in turn, has a member extending therefrom such as a roll pin or small diameter stub shaft 58 suitably secured thereto and extending therefrom radially for bearing against the flat radially extending surface 56 on the stop or extension 54, to transmit drive from the shaft 48 to the hammer 50, but with such pin 58 only physically bearing on the surface 56 and being readily movable in relation thereto. In effect, this provides a unidirectional clutch means between the drive shaft and the hammer means 50.

So as to provide a rapid propelling action for the hammer 50, a coil spring 60 has one end thereof indicated at 62 anchored in any one of a plurality of positions provided at spaced portions of the disc-like bottom portion 43 of the base 40, as hereinafter described. The spring extends up to and engages a boss 66 formed on and protruding from a portion of the hammer, offset appreciably radially from the extension stop 54, which coil spring end is secured in position as by use of a fastener 68. Thus, with the drive shaft 48 being slowly continuously driven by the motor means provided, the hammer is forced to turn slowly in a clockwise direction to gradually tension the coil spring 60. However, the coil spring 60 will be moved in relation to the center of rotation of the hammer means so as to move past a dead center position indicated in the drawings. When such spring has moved over dead center, it provides an immediate fast clockwise striking action of the hammer means by the coil spring snapping back to its normal length. Such action causes a flat surface 59 on the hammmer to strike a ball indicated at "B", positioned at a stop station in the ball supply portion of the housing formed by an end flange 71 so as to strike the ball vigorously and propel it upwardly and outwardly of the housing. A slot 70 is provided in the periphery of the cylindrical wall 30 of the base section to permit the ball to move upwardly and outwardly of the housing. At the same time, it will be realized that the spring has pulled the hammer means and the extension or stop thereon out of engagement with the drive pin 58 or the like extending from the drive shaft so that automatic disengagement therebetween permits the rapid striking action of the hammer. As the motor drives the shaft 48 around continuously, then ultimately the pin 58 will again engage the flat surface 56 on the extension section 54, and pick up the hammer to start moving it around for another ball propelling action. During such time interval, of course, another ball has rolled down in the helical ball storage path provided in the apparatus to be positioned for next propulsion from the apparatus of the invention.

It will be understood that the ball support floors 34, 36 and 38 provided on the various housing sections are designed and the sections are so formed that such portions of the ball support floors will smoothly engage with each other and blend together to form the desired helical ball storage and automatic ball supply path in the apparatus of the invention.

Adjustment of the tension provided in the spring 60 can be varied by use of any suitable means such as a plurality of attachment portions formed in a parallel slotted area 80 of the base of the apparatus. This area 80 has a plurality of upwardly extending fingers 82 projecting therefrom and lower recessed sections 84 in the bottom of the base of the apparatus to receive and aid in positioning a coil spring attaching ring 86. By the slots in the area 80 being so positioned that the fingers 82 are located at varying distances from the center of rotation of the shaft 48 and hammer means 50, the ring 86 to which the end of the spring 60 is secured can be anchored at different portions of the area 80 to retain the ring in a given position. This provides a center rib in the area 80 to engage a spring end and permit some appreciable variation in the location of the one end of the coil spring whereby the amount of ball propelling and striking force of the spring can be adjusted. The coil spring 60 is laterally offset from the stop 54.

Figure 4:
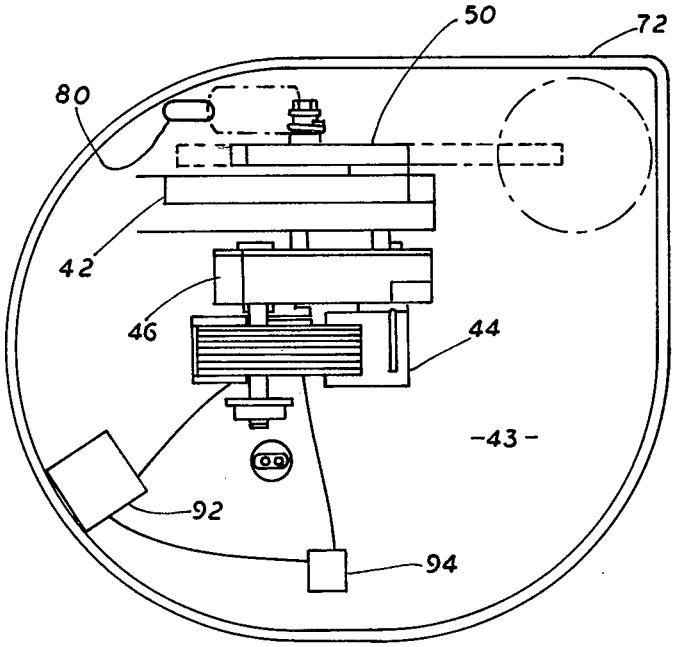
FIG. 4 is a plan view of the base of FIG. 3.

FIGS. 1 and 4 of the drawings best show that there is an offset section 72 provided in the housing base to form the ball propelling and locating station. The inclination of the ball support and supply path can be made sharper in the base or bottom section of the housing to insure that balls therein will roll down automatically under gravity action to reach the ball propelling station. The housing is offset at the discharge area thereof.

The offset portion 72 formed in the housing terminates the ball storage and supply path at a stop flange 71 at the propelling station. A slot 76 is formed in the inner wall and floor of the ball control path for the hammer means to swing through and knock the ball out of the housing. A V-shaped floor 78 at such station aids the ball in being knocked up and out of the housing.

In some instances, it may be desirable to provide another type of a ball storage and supply means in the apparatus, but in all events, the apparatus provides a continuously driven, intermittently functioning ball throwing apparatus well adapted to strike and propel small lightweight balls a desirable distance for tennis practicing actions.

The apparatus can be controlled by use of a suitable control switch 92 connecting to power means, such as a battery 94 or the like, and in turn connecting to the motor unit of the apparatus. Of course, if desired, external power supply means may be used and connect to the motor by a transformer or other conventional control means in order to provide a slowly driven ball propelling motor that will just intermittently function to strike and project or throw any balls received in the housing therefrom. Naturally, if the apparatus is powered when the supply of balls is exhausted, then the apparatus will just continue to function without any damage thereto, but obviously there will be no resultant ball propelling action.

Figure 5:
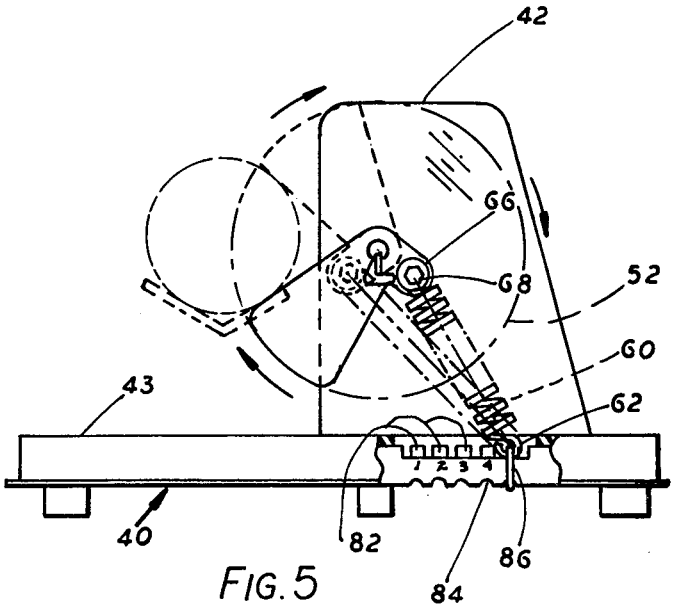
FIG. 5 is a left side elevation of the base of the housing.
Figure 6:
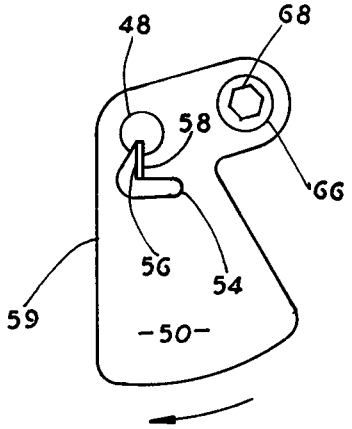
FIG. 6 is an enlarged elevation of the hammer means.
Figure 7:
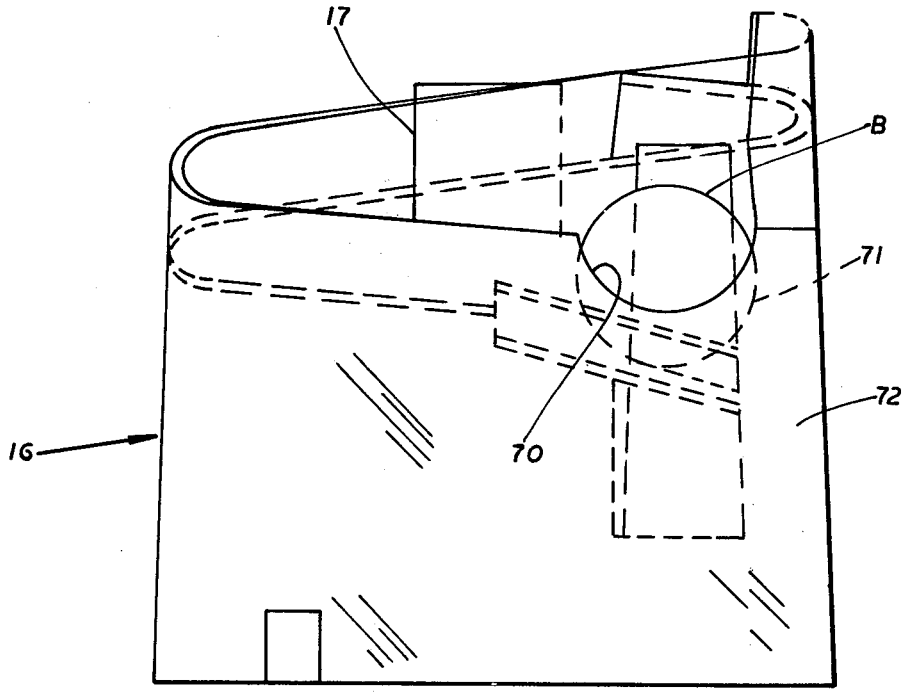
FIG. 7 is a left side elevation of the bottom housing section of the apparatus.

After a ball propelling striking action by the hammer means of the apparatus, it will just continue its rotation down to a lowermost spring retracted position and then be again picked up by the pin 58 extending from the motor drive shaft to drive the hammer means positively for slowly cocking the spring for the next striking action. The coil spring pulls the hammer means down to the position indicated in FIG. 5 after the ball propelling action to await further driven rotary movement of the motor shaft to provide the mechanical contacting clutch engaging action as described hereinbefore.

A lightweight, portable ball storage and throwing means is provided by the invention to throw individual balls out automatically under controlled forces. The housing may be made from molded plastic sections or be made from other materials, as desired. The apparatus is uncomplicated and will function effectively with minimal maintenance.

While one complete embodiment of the invention has been disclosed herein, it will be appreciated that modification of this particular embodiment of the invention may be resorted to without departing from the scope of the invention.

What is claimed is:

1. In a portable ball propelling apparatus, a frame including a molded plastic housing forming a helical ball storage and supply path ending in a ball stop positioning station, a ball hammer means, a driven shaft on which said hammer means is journalled, connector clutch means between said shaft and said ball hammer means to move said hammer means in only one direction, said hammer means being rotatably positioned to move to and through a portion of the volume of a ball in said helical pathat said stop positioning station, spring means on said frame directly and operably engaged by said hammer means and frame to be tensioned by rotary movement of said hammer means in one direction to advance it rapidly as such hammer means is moved over a dead center position for ball striking action, and said housing is made from a plurality of sections including interengaging tubular center portions on each of said sections that secure the sections together; top, bottom, and two center sections are provided and said two center sections are identical; and said sections all include floor and outer wall portions smoothly connecting to each other to form a helical ball storage and supply device.

2. Apparatus as in claim 1 where said housing has an offset bottom portion in which said ball stop positioning station is formed, and portions of the walls and floor of said housing in said bottom portion are slotted for said hammer means to pass therethrough to strike a ball and propel the same.

* * * * *